US006371296B1

(12) United States Patent
Rumbough

(10) Patent No.: US 6,371,296 B1
(45) Date of Patent: Apr. 16, 2002

(54) STUFFY BOX

(76) Inventor: Sheila Rumbough, 12938 Eryn Blvd., Clermont, FL (US) 34711

( * ) Notice: Subject to any disclaimer, the term of this patent is extended or adjusted under 35 U.S.C. 154(b) by 0 days.

(21) Appl. No.: 09/716,808

(22) Filed: Nov. 20, 2000

(51) Int. Cl.[7] ..... B65D 73/00

(52) U.S. Cl. ..... 206/494; 206/233; 206/459.1; 40/420

(58) Field of Search ..... 206/233, 494, 206/575, 578, 232, 457, 449, 455, 459.1; 40/722, 725, 734, 790, 791, 720

(56) References Cited

U.S. PATENT DOCUMENTS

| | | | | | |
|---|---|---|---|---|---|
| 3,072,245 | A | * | 1/1963 | Faltin | 206/233 |
| 3,089,583 | A | * | 5/1963 | White | 221/34 |
| 3,245,580 | A | * | 4/1966 | Campanella | 221/34 |
| 3,327,688 | A | * | 6/1967 | Smith | 206/232 |
| 3,372,837 | A | * | 3/1968 | Neumann | 221/34 |
| 3,596,391 | A | * | 8/1971 | Knight, Jr. | 40/270 |
| 3,703,045 | A | * | 11/1972 | Nyman | 40/720 |
| 4,483,440 | A | * | 11/1984 | Ware | 206/233 |
| 4,623,063 | A | * | 11/1986 | Balkin | 206/408 |
| D290,227 | S | * | 6/1987 | Zutler | 206/457 |
| 4,919,302 | A | * | 4/1990 | McPherson | 221/34 |
| 4,968,565 | A | * | 11/1990 | Stefano | 428/542.4 |
| 5,054,612 | A | * | 10/1991 | Meyer, Jr. | 206/233 |
| 5,277,307 | A | * | 1/1994 | Kelly | 206/457 |
| 5,439,104 | A | | 8/1995 | Wolska-Klis | |
| D371,708 | S | | 7/1996 | Haley et al. | |
| D381,227 | S | | 7/1997 | Cockrum | |
| D381,228 | S | | 7/1997 | Cockrum | |
| 5,651,152 | A | | 7/1997 | Ritchie et al. | |
| 5,718,336 | A | * | 2/1998 | Harrlander | 206/542 |
| D403,189 | S | | 12/1998 | Isaacson | |
| D407,211 | S | * | 3/1999 | Diviak, Sr. | D3/206 |
| 6,173,837 | B1 | * | 1/2001 | Marconi | 206/457 |
| D444,177 | S | * | 6/2001 | Carretta | D19/35 |

* cited by examiner

*Primary Examiner*—Shian Luong
(74) *Attorney, Agent, or Firm*—Brian S. Steinberger; Law Offices of Brian S. Steinberger, P.A..

(57) ABSTRACT

Receptacle for holding a disposable boxes of tissues therein. The receptacle has two compartments, one for holding a full box of tissues and a second trash receptacle for holding an empty box of tissues, wherein the empty box of tissues is used as a trash bin for the full box of tissues. After the full box of tissues is emptied, the user removes the trash bin box and inserts a new box of tissues therein, and the empty box of tissues is used as a trash bin. Holders such as raised frame edges, and a separate outer wall allow for card shaped objects such as photographs and postcards, and the like, to be inserted and displayed.

13 Claims, 5 Drawing Sheets

28
32
30
20

48
42
60

4
22
18
20
30
10
16
34
50
36
30
10
14
38
40
12
42
2
48

B
18
16
14
60
12
1
A

100
YY
YY
135
131
130
140
141
111
70
80
110
150
130
120
121
115
110
131
130
120
121

D
C
114
111
112
115
118
160

121
122
123
120
128

STUFFY BOX

This invention relates to containers, and in particular to a tabletop receptacle for holding both a full mini box of disposable tissues and an empty box in a side-by-side arrangement where the receptacle exterior side mounts for allowing card shaped objects such as 4×6 inch photographs and postcards to be displayed and stored therein.

BACKGROUND AND PRIOR ART

Boxes of disposable tissues have been become more popular in recent times. Often the boxes have included colorful design patterns on the outside of the boxes. However, many users do not like the colors and/or design patterns.

Additionally, the user still must find a place to throw out the used tissues that come from the tissues boxes.

Various types of tissue box storage containers have been proposed over the years. See for example, U.S. Pat. Des. No. 371,708 to Haley et al.; Des. 381,227 to Cockrum; Des. 381,228 to Cockrum and Des. 403,189 to Isaacson. However, each of these patents is for ornamental designs for tissue box holders. Thus, the user is restricted to the ornamental design of the outer box when it is used to cover the tissue box.

Other devices have been proposed for holding tissues such as U.S. Pat. Nos. 5,439,104 to Wolska-Klis and U.S. Pat. No. 5,651,152 to Ritchie et al., but also fail to overcome the deficiencies described above.

SUMMARY OF THE INVENTION

The first objective of the invention is to provide a receptacle for storing a full disposable tissue box and an empty disposable tissue box side-by-side to one another.

The second objective of the invention is to provide a receptacle for storing tissue boxes that can hold cards such as photographs and postcards on outside sidewalls of the receptacle.

The third objective of the invention is to provide a receptacle having a slot for storing a tissue box and a slot for holding trash.

A receptacle-holder according to the invention includes a receptacle having an open top, closed sides and a bottom, and an inside wall separating the receptacle into a first compartment and a second compartment. Each of the compartments can include dimensions of approximately 6 inches by approximately six inches for allowing disposable mini tissue boxes to be inserted into each compartment. In use a full disposable box of tissues is located in one compartment, while an empty disposable box is located in the adjacent compartment. After the box of tissues is depleted, the user can remove the tissue box that was used as a trash bin and replace the same with a full disposable box of tissues. The invention allows the user to alternate using up disposable tissue boxes and recycling each tissue box into a trash bin and alternating each compartment to be a tissue box holder and a trash bin holder. The invention eliminates the need for separate liners that are normally used with trash bins.

On the outside walls of the receptacle are holders for supporting card shaped objects such as postcards, photographs, and the like. The holders can be raised edges that allow a flexible frame shape to be on the outside and the photograph on the inside. The holders can also include preformed frame shapes with openings for displaying the underlying photograph. Additionally, the invention can use double walls, the outer side wall having a transparent portion, and a slot between the outer wall and the inner wall for allowing the card shaped objects to be inserted therein. The outer wall can also have a higher height than the inner wall thus allowing the user to physically grab onto a top edge of the card shaped object. Displaying the card shaped objects allows for the user to customize the appearance of the receptacle, and eliminate others from seeing any designs that already exist on the disposable tissue boxes.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figures 1A, 1B, 1C, 1D:
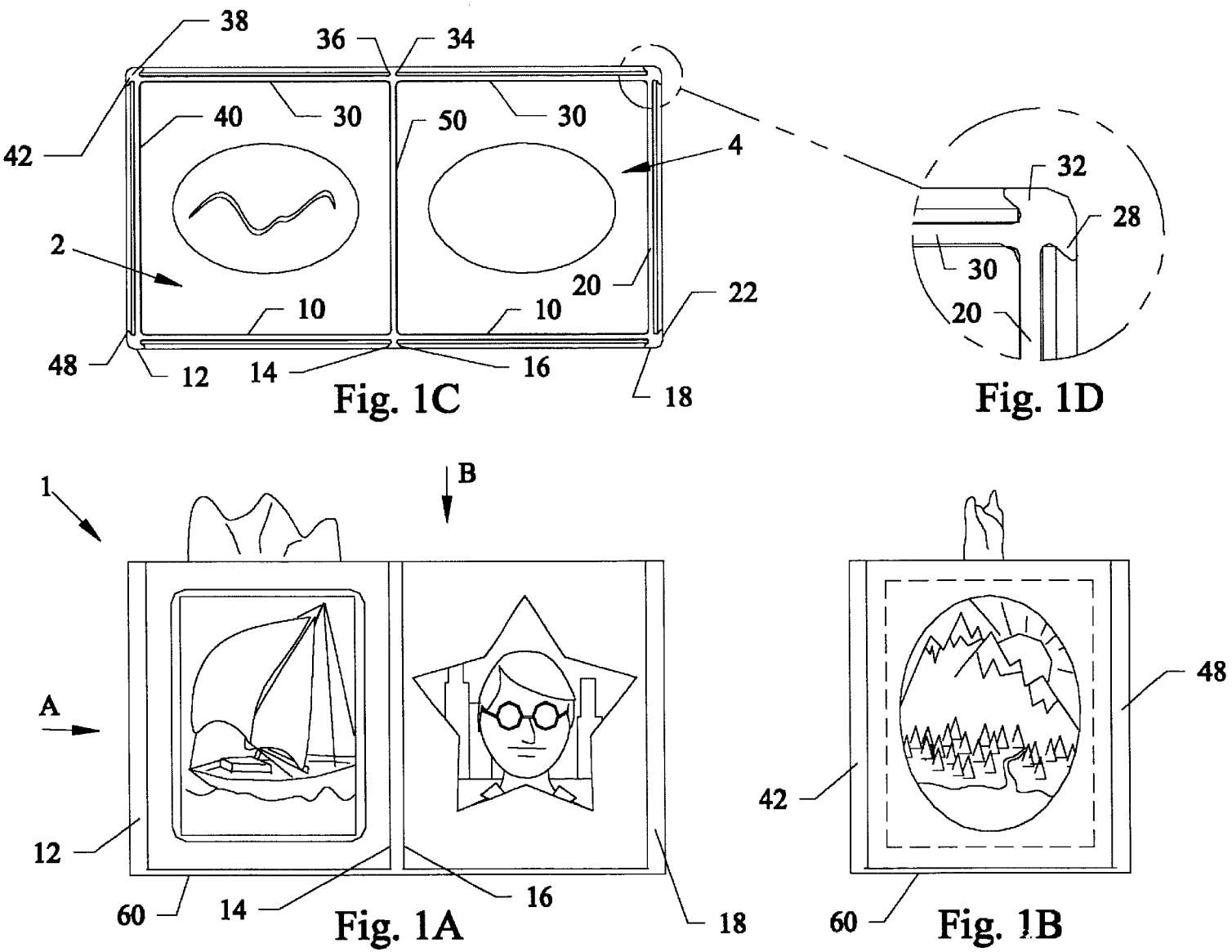
FIG. 1A is a side view of a first embodiment receptacle of the invention.
FIG. 1B is an end view of the receptacle of FIG. 1A along arrow A.
FIG. 1C is a top view of the receptacle of FIG. 1A along arrow B.
FIG. 1D is an enlarged view of an upper corner of the receptacle of FIG. 1A.

FIG. 1A is a side view of a first embodiment receptacle 1 of the invention. FIG. 1B is an end view of the receptacle 1 of FIG. 1A along arrow A. FIG. 1C is a top view of the receptacle 1 of FIG. 1A along arrow B. FIG. 1D is an enlarged view of an upper corner of the receptacle 1 of FIG. 1A. Referring to FIGS. 1A–1D, receptacle 1 includes a generally rectangular shape having an open top, four closed sides 10, 20, 30, and 40 and a central dividing wall 50 for dividing the interior of the receptacle into two compartments 2 and 4, and a closed bottom 60. Each of the compartments 2 and 4 can have bottom dimensions of approximately 6 inches by approximately 6 inches, to be sized to hold mini disposable tissue boxes. On the outside of receptacle 1 are raised frame edges 12 & 48, 14 & 16, 18 & 22, 28 & 32, 34 & 36, and 38 & 42 that each form slots for allowing card typed shapes to be inserted therein. The outer surfaces of these raised frame edges can be blunted, rounded, and the like, so as not to have any sharp portions that would be difficult to handle, as well as uncomfortable to use. The material that can be used to form the receptacle 1 can be injection-molded plastic, and the like. The receptacle can be made in different colors, such as but not limited to clear transparent material, and various colors, color combinations, and the like.

Figure 3:
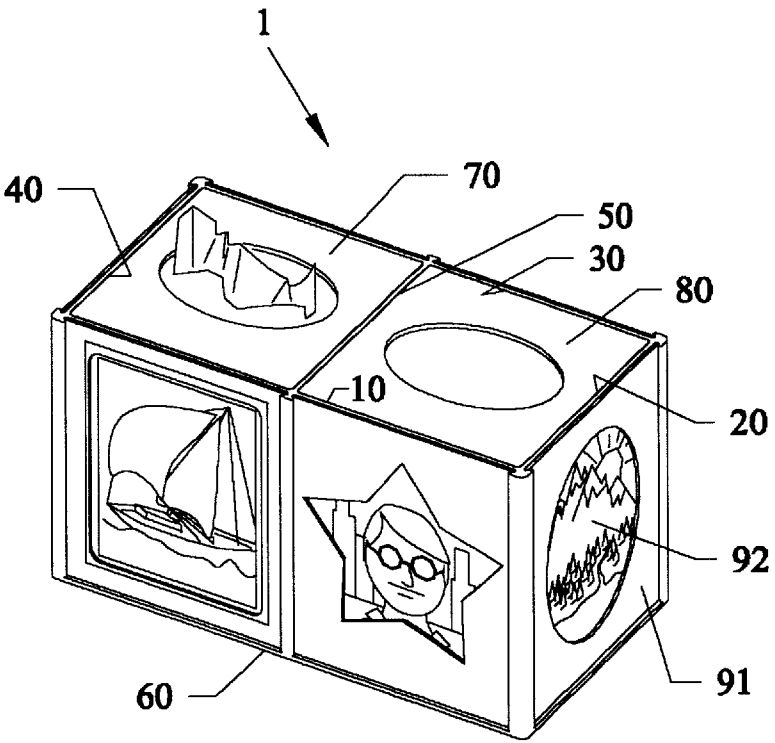
FIG. 3 is a perspective view of FIG. 2 after the box and photograph with frame have been inserted.
Figure 2:
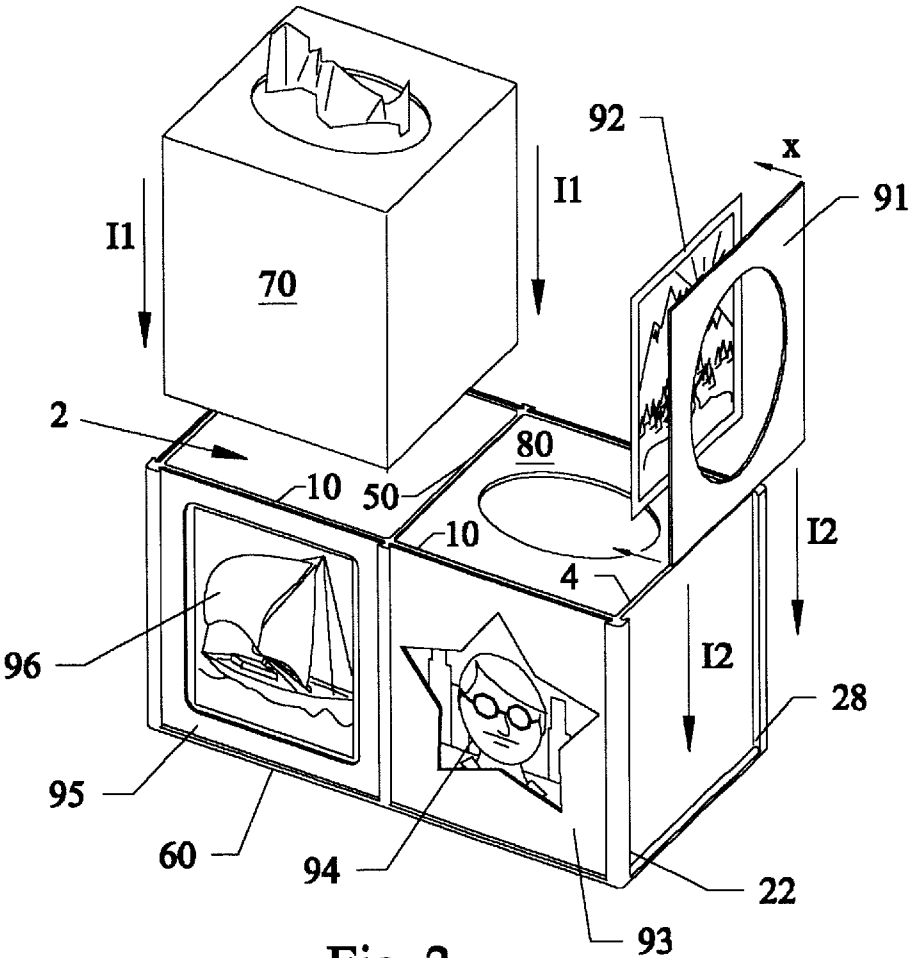
FIG. 2 is a perspective view of a full tissue box and a photograph with frame being inserted into the receptacle of FIGS. 1A–1B.

FIG. 2 is a perspective view of a full tissue box and a photograph with frame being inserted into the receptacle 1 of FIGS. 1A–1B. FIG. 3 is a perspective view of FIG. 2 after the box and photograph with frame have been inserted. Referring to FIGS. 2–3, a full disposable tissue box 70 can be inserted into compartment 2 by inserting box 70 in the direction of arrow 11 into compartment 2, and a frame type card with a circular opening 91 can be moved in the direction of arrow X against a card shaped item 92, such as a photograph, postcard, and the like, where both are then inserted into the slot forming edges 22, 28 in the direction of arrow 12. The card shaped items 92, 94, and 96 can be but are not limited to 4×6 photographs, and the like. Similarly, other frames 93, 95 with different shaped openings star, rectangular, respectively, can be similarly inserted into their respective slot edges, along with other card shaped objects 94, 96. Receptacle 1 can initially be used with one full disposable tissue box 70, and one empty disposable tissue box 80 being used as a trash bin. When box 70 is used up and becomes empty, trash bin box 80 is then removed and a new full tissue box is inserted into compartment 4, and box 70 becomes a trash bin. The invention can be continuously used alternating between using compartment 2 and 4 to hold full disposable tissue boxes and empty disposable tissue boxes as trash bins. The invention is able to use an empty disposable tissue box as a liner for the receptacle compartments 2 and 4, thus eliminating the need to buy and use separator trash bin liners, such as plastic bags, and the like.

Figures 4A, 4B, 4C, 4D:
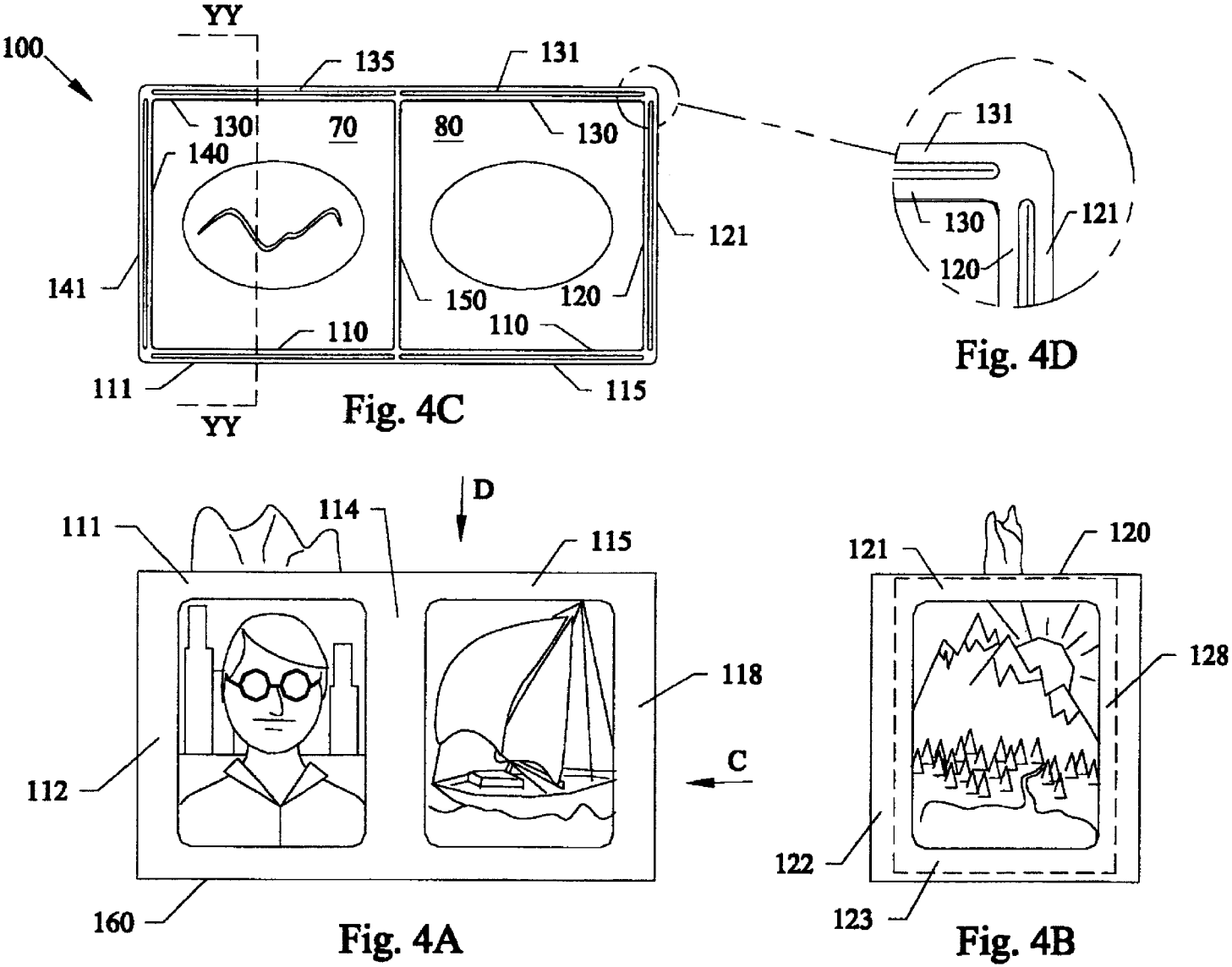
FIG. 4A is a side view of a second embodiment receptacle of the invention.
FIG. 4B is an end view of the receptacle of FIG. 4A along arrow C.
FIG. 4C is a top view of the receptacle of FIG. 4A along arrow D.
FIG. 4D is an enlarged view of an upper corner of the receptacle of FIG. 4A.

FIG. 4A is a side view of a second embodiment receptacle 100 of the invention. FIG. 4B is an end view of the receptacle 100 of FIG. 4A along arrow C. FIG. 4C is a top view of the receptacle 100 of FIG. 4A along arrow D. FIG. 4D is an enlarged view of an upper corner of the receptacle 100 of FIG. 4A. Referring to FIGS. 4A–4D, receptacle 100 includes a generally rectangular shape having an open top, four closed sides 110, 120, 130, and 140 and a central dividing wall 150 for dividing the interior of the receptacle into two compartments 102 and 104, and a closed bottom 160. Each of the compartments 102 and 104 can have bottom dimensions of approximately 6 inches by approximately 6 inches, to be sized to hold mini disposable type tissue boxes. On the outside of receptacle 100 are raised outer wall frame portions 111, 112, 113, 114, 115, 116, 117, 118, 121, 122, 123, 128, 131, 135, 141 that have an open slot top for allowing card typed shapes to be inserted therein (although only frame portions 111–118 of side wall 110 are labeled, the other walls 120, 130 and 140 have similar frame wall portions). The outer surfaces of these raised frame edges can be blunted, rounded, and the like, so as not to have any sharp portions that would be difficult to handle, as well as uncomfortable to use. The material that can be used to form the receptacle 100 can be injection-molded plastic, and the like. The receptacle can be made in different colors, such as but not limited to clear transparent material, and various colors, color combinations, and the like.

Figure 6:
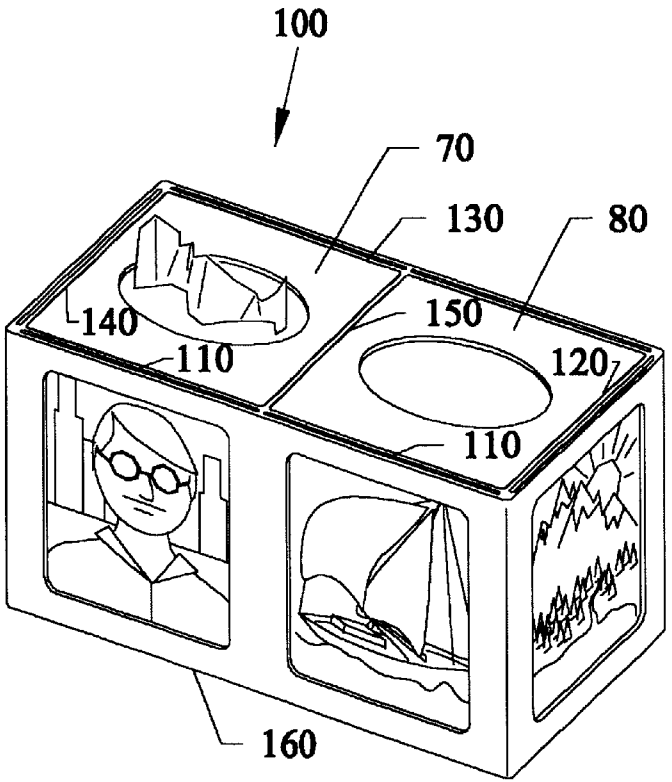
FIG. 6 is a perspective view of FIG. 5 after the tissue box and photograph have been inserted.
Figure 5:
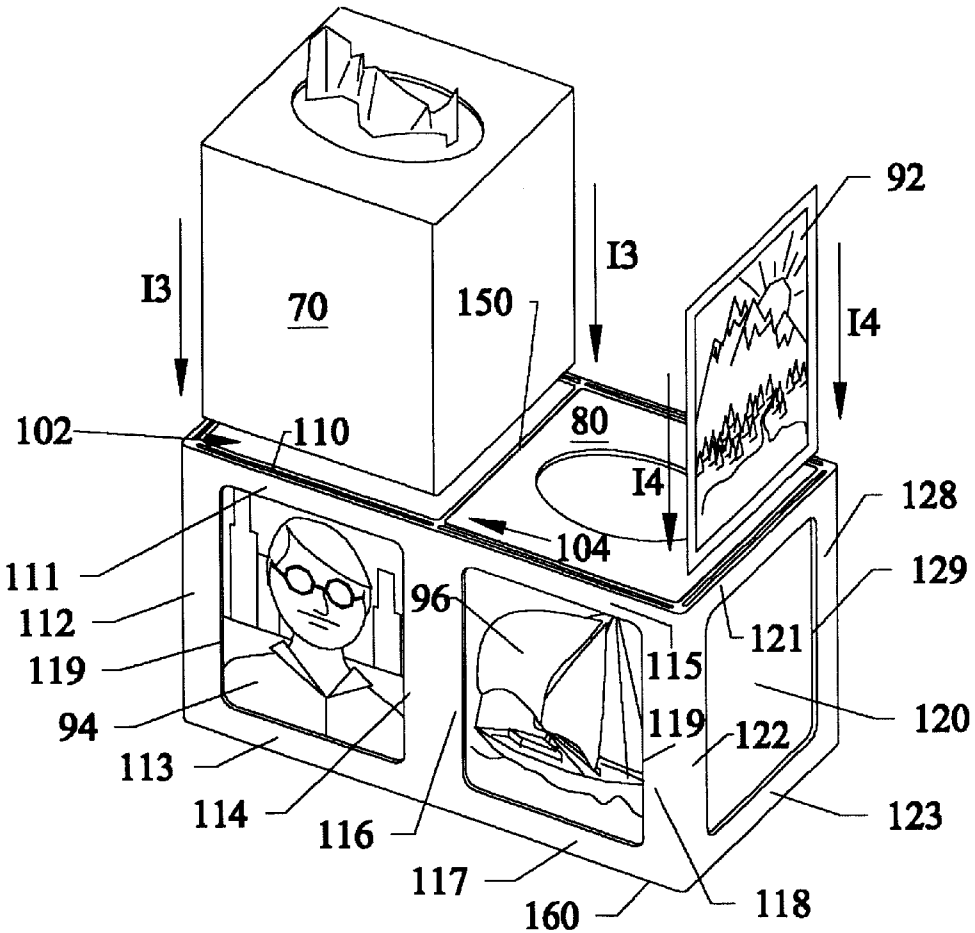
FIG. 5 is a perspective view of a full tissue box and a photograph being inserted into the receptacle of FIGS. 4A–4D.

FIG. 5 is a perspective view of a full tissue box 70 and a photograph 92 being inserted into the receptacle of FIGS. 4A–4D. FIG. 6 is a perspective view of FIG. 5 after the tissue box 70 and photograph 92 have been inserted. Referring to FIGS. 5–6, a full disposable tissue box 70 can be inserted into compartment 102 by inserting box 70 in the direction of arrow 13 into compartment 102, and a card shaped item 92, such as a photograph, postcard, and the like, can be inserted into the slot between sidewall 120 and front frame portions 121, 122, 123, 128 in the direction of arrow 14. The card shaped items 92, 94, and 96 can be but are not limited to 4×6 photographs, and the like. The openings 119, 129 in the outer frame portions can be rectangular shaped. Alternatively, these openings can be preformed into other shapes such as but not limited to the star, circular shapes, and the like, described in the first embodiment. The second embodiment 100 eliminates the need for having to insert frame shaped cards by having preformed frame shaped openings. Similar to the first embodiment, Receptacle 100 can initially be used with one full disposable tissue box 70, and one empty disposable tissue box 80 being used as a trash bin. When box 70 is used up and becomes empty, trash bin box 80 is then removed and a new full tissue box is inserted into compartment 4, and box 70 becomes a trash bin. The invention can be continuously used alternating between using compartment 102 and 104 to hold full disposable tissue boxes and empty disposable tissue boxes as trash bins. The invention is able to use an empty disposable tissue box as a liner for the receptacle compartments 102 and 104, thus eliminating the need to buy and use separate trash bin liners, such as plastic bags, and the like.

Figure 7:
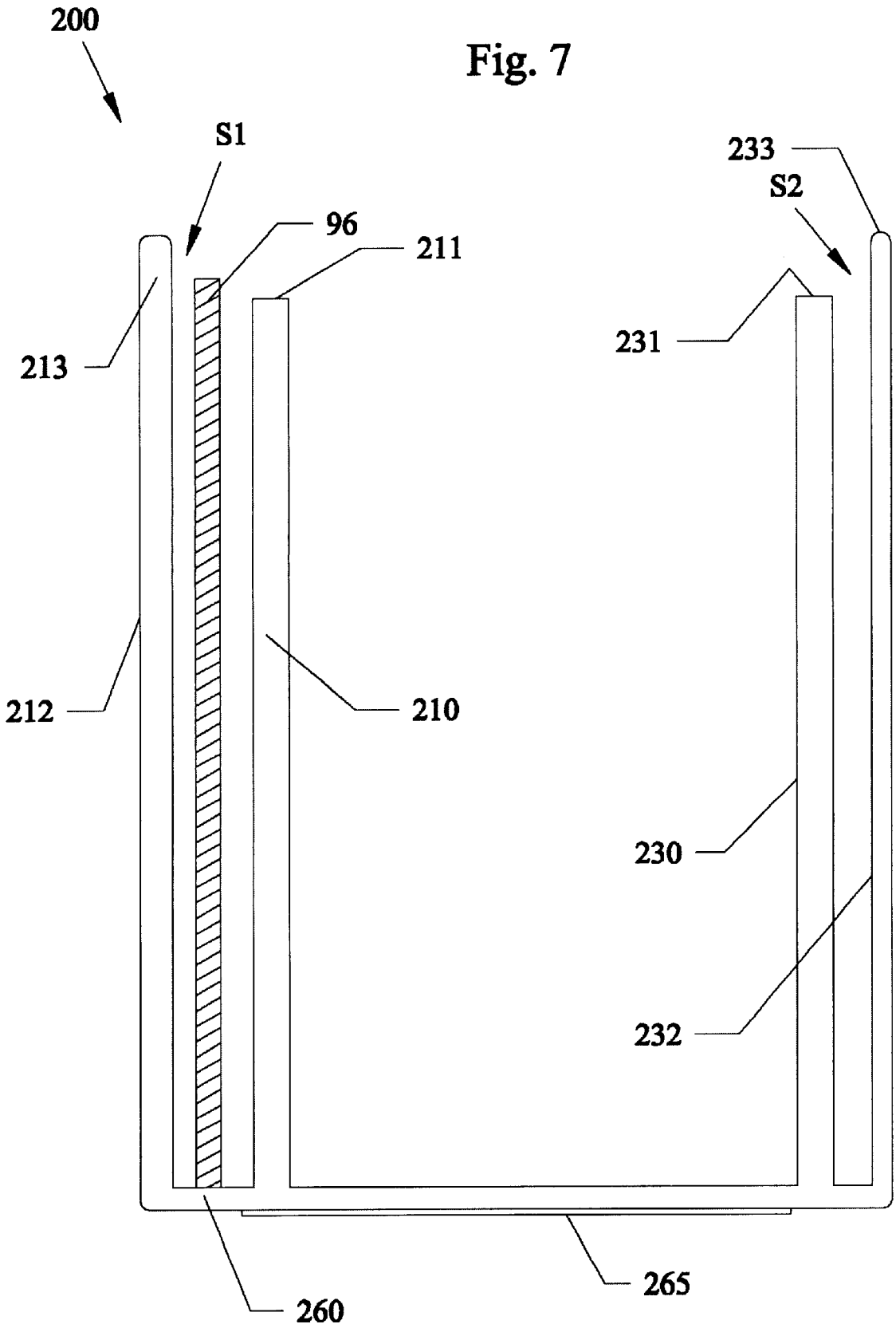
FIG. 7 is a side cross-sectional view of another version of FIGS. 4A–4D showing the inner walls having a lower height than the exterior walls in order to access the photographs inserted therein.

FIG. 7 is a side cross-sectional view of FIG. 4C along arrows YY which is another version of FIGS. 4A–4D showing the inner walls 210, 230 having a lower height 211, 231 than the height 213, 233 of exterior walls 212, 232 in order to access the photographs 96 inserted therein. Here, instead of outer frame portions having actual openings as shown in the preceding figures, the invention has a transparent outer walls 212, 232 with slots S1, S2, between these outer walls and the inner walls 210, 230. The user can grab the upper edge of the card shaped objects 96 in order to insert and remove these objects from the slots S1, S2. The transparent outer walls 212, 232 can have painted on frames on the outside as well, and also can have cutouts in the outer walls similar to those previously described. On the bottom of the receptacle 200 can be another layer of material 265 such as a felt surface so that the receptacle can be placed on surfaces such as wood surfaces without marring those surfaces. Additionally, the layer 265 can be double sided tape that allows the user to place the receptacle in semi-permanent locations in order to restrict the movement thereof, such as in a vehicle, boat, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A receptacle-holder, comprising in combination:

a receptacle having an open top, closed sides and a bottom, and an inside wall separating the receptacle into a first compartment and a second compartment;

a disposable box of tissues located in the first compartment;

an empty disposable box located in the second compartment, wherein the empty box is used as a trash bin for used tissues from the box of tissues;

card shaped objects; and a double wall on at least one exterior side forming slots therebetween for supporting the card shaped objects within the double wall, the double wall including an exterior wall and an interior wall, wherein the interior wall is smaller in height than the exterior wall for allowing the card shaped objects to be accessed.

2. The receptacle-holder of claim 1, wherein the exterior wall includes: transparent material.

3. The receptacle-holder of claim 1, wherein the card-shaped objects include:

postcards.

4. The receptacle-holder of claim 1, wherein the card-shaped objects include:

photographs.

5. The receptacle-holder of claim 1, wherein each of the first compartment and the second compartment include:

dimensions of approximately 6 inches by approximately 6 inches.

6. A receptacle-holder, comprising in combination:

a receptacle having an open top, four closed sides and a bottom, and an inside wall separating the receptacle into a first compartment and a second compartment, each of the first compartment and the second compartment include dimensions of approximately 6 inches by approximately six inches;

a disposable box of tissues located in the first compartment;

an empty disposable box located in the second compartment, wherein the empty box is used as a trash bin for used tissues from the box of tissues;

card-shaped objects; and support means on each of the four sides of the receptacle for supporting the card-shaped object therein.

7. The receptacle-holder of claim 6, wherein the card-shaped objects include:

postcards.

8. The receptacle-holder of claim 6, wherein the card-shaped objects include:

photographs.

9. The receptacle-holder of claim 8, wherein the card-shaped objects further include:

a frame shaped card with an opening for allowing the photographs to be seen.

10. The receptacle-holder of claim 6, wherein the support means includes:

raised frame edges for supporting side edges of the card shaped objects.

11. The receptacle-holder of claim 6, wherein the support means includes:

double walls forming slots therebetween for supporting the card shaped objects.

12. The receptacle-holder of claim 11, wherein each of the double walls includes:

an exterior wall and an interior wall, the interior wall being smaller in height than the exterior wall for allowing the card shaped objects to be accessed.

13. The receptacle-holder of claim 6, wherein the support means further includes:

six holders for supporting the card shaped holders on the four sides of the receptacle.

* * * * *